US010398166B2

(12) United States Patent
Franke et al.

(10) Patent No.: US 10,398,166 B2
(45) Date of Patent: Sep. 3, 2019

(54) MODULAR TOBACCO PREPARATION INCLUDING EXTRUSION

(71) Applicant: BRITISH AMERICAN TOBACCO (GERMANY) GMBH, Hamburg (DE)

(72) Inventors: Dietmar Franke, Bayreuth (DE); Gerald Schmekel, Koelln-Reisiek (DE)

(73) Assignee: BRITISH AMERICAN TOBACCO (GERMANY) GMBH, Hamburg (DE)

( * ) Notice: Subject to any disclaimer, the term of this patent is extended or adjusted under 35 U.S.C. 154(b) by 444 days.

(21) Appl. No.: 15/149,567

(22) Filed: May 9, 2016

(65) Prior Publication Data

US 2017/0035097 A1 Feb. 9, 2017

Related U.S. Application Data

(62) Division of application No. 13/124,614, filed as application No. PCT/EP2009/062287 on Sep. 22, 2009, now Pat. No. 9,351,519.

(30) Foreign Application Priority Data

Oct. 17, 2008 (DE) ..... 10 2008 052 209

(51) Int. Cl.
*A24B 3/00* (2006.01)
*A24B 3/08* (2006.01)
(Continued)

(52) U.S. Cl.
CPC ..... *A24B 13/00* (2013.01); *A24B 3/00* (2013.01); *A24B 3/08* (2013.01); *A24B 3/10* (2013.01); *A24B 3/18* (2013.01)

(58) Field of Classification Search
None
See application file for complete search history.

(56) References Cited

U.S. PATENT DOCUMENTS 3,968,804 A 7/1976 Kelly
4,702,264 A 10/1987 Graves
(Continued)

FOREIGN PATENT DOCUMENTS

AU 2009304133 A1 4/2010
CN 102186365 A 9/2011
(Continued)

OTHER PUBLICATIONS

International Search Report for corresponding application PCT/EP2009/062287; dated Dec. 8, 2009.

*Primary Examiner* — Phu H Nguyen
(74) *Attorney, Agent, or Firm* — Cantor Colburn LLP

(57) ABSTRACT

A tobacco preparation method, where a tobacco material is prepared through at least one extrusion process including compressing the material with an increase in pressure and temperature and mechanically processing and abruptly flash drying the material at an extruder outlet, wherein the tobacco material includes a tobacco lamina material, where a tobacco preparation device includes a dosing conveyor and an extruder which compresses a tobacco material with an increase in pressure and temperature and mechanically process and abruptly flash dries the material at the extruder outlet, where the components are designated as a unit which can be modularly delimited for processing a tobacco material including a tobacco lamina material, where an arrangement of several tobacco preparation devices and a smoking article or cigarette manufacturing device includes such a device or such a device arrangement which is connected upstream of a cigarette maker or a secondary unit as a tobacco preparation module.

6 Claims, 5 Drawing Sheets

(51) Int. Cl.

| | |
|---|---|
| ***A24B 3/10*** | (2006.01) |
| ***A24B 3/18*** | (2006.01) |
| ***A24B 13/00*** | (2006.01) |

(56) References Cited

U.S. PATENT DOCUMENTS

| | | | | |
|---|---|---|---|---|
| 4,768,527 | A * | 9/1988 | Graves, Jr. ..... | A24B 3/14<br>131/353 |
| 4,821,749 | A | 4/1989 | Toft | |
| 4,880,018 | A | 11/1989 | Graves | |
| 7,934,509 | B2 * | 5/2011 | Ehling ..... | A24B 3/18<br>131/297 |
| 2005/0178398 | A1 | 8/2005 | Breslin | |
| 2007/0026095 | A1 | 2/2007 | Lewis | |

FOREIGN PATENT DOCUMENTS

| | | | |
|---|---|---|---|
| DE | 102008052209 | A1 | 4/2010 |
| EP | 1847186 | A1 | 10/2007 |
| JP | 5439490 | B2 | 3/2014 |
| MY | 151344 | A | 5/2014 |
| RU | 2011119475 | A | 11/2012 |
| UA | 99676 | C2 | 9/2012 |
| WO | 2006061117 | A1 | 6/2006 |

* cited by examiner

| VARIANT | NUMBER OF EXTRUDER CELLS (DEPENDING ON THROUGHPUT RATE, AN INTEGER MULTIPLE IS NECESSARY AS APPLICABLE) | | | | COMMENTS |
|---|---|---|---|---|---|
| TOBACCO NON-THRESHED<br>WITHOUT TOBACCO SPECIALISATION | DEPENDING ON CAPACITY, A MINIMUM OF 1 EXTRUDER NECESSARY | | | | WHOLE LEAF PROCESSING |
| TOBACCO THRESHED<br>STEMS AND LAMINA SEPARATELY TREATED | | DEPENDING ON CAPACITY, A MINIMUM OF 2 EXTRUDERS NECESSARY | | | SETTING DIFFERENT CUTTING WIDTHS, CASING |
| TOBACCO THRESHED<br>SEPARATE TREATMENT OF STEMS, BURLEY, VIRGINIA + ORIENT TOGETHER | | | DEPENDING ON CAPACITY, A MINIMUM OF 3 EXTRUDERS NECESSARY | | SETTING DIFFERENT CUTTING WIDTHS, CASING, BURLEY EXTRUDER TOASTING |
| TOBACCO THRESHED<br>SEPARATE TREATMENT OF STEMS, BURLEY, VIRGINIA, ORIENT | | | | DEPENDING ON CAPACITY, A MINIMUM OF 4 EXTRUDERS NECESSARY | ILLUSTRATION OF STANDARD TOBACCO TREATING, COMPRISING EXTRUDER MODULES |

FIG. 2

MODULAR TOBACCO PREPARATION INCLUDING EXTRUSION

CROSS REFERENCE TO RELATED APPLICATIONS

This application is a divisional of U.S. patent application Ser. No. 13/124,614 filed on 10 Aug. 2011, which is the U.S. National Stage of International Patent Application Number PCT/EP2009/062287 filed on 22 Sep. 2009, which claimed priority to German Patent Application Number 102008052209 filed on 17 Oct. 2008, all of which said applications are herein incorporated by reference in their entirety.

TECHNICAL FIELD

The invention relates to the field of preparing tobacco within the framework of manufacturing smoking products, in particular cigarettes. Specifically, the invention relates to a modular tobacco preparation for processing raw tobacco, in order to manufacture smokable cut tobacco and/or cigarettes.

BACKGROUND

In conventional tobacco processing, most of the process steps—such as conditioning, saucing, cutting, drying and expanding—are performed in separate standard apparatus such as drums, vaporizing tunnels, airflow dryers, belt dryers, etc. The tobacco is supplied to all of these apparatus as bulk material. During the processes, the tobacco is not generally subjected to any particular compression; cutting the tobacco is the only exception to this. Thus, the tobacco is processed largely at its natural filling capacity, resulting in large-volume apparatus for processing, which have to be erected in corresponding buildings.

Arranging treating devices one above the other ("vertical tobacco preparation") in order to reduce the space requirement is known from DE 10 2004 043 833. To this end, it is of course necessary to provide correspondingly high buildings. It is also common practice to use buffer boxes in order to decouple processes, which in turn increases the space requirement as a whole.

A typical example of a specialized standard tobacco preparation in accordance with the prior art may be gathered from FIG. 5. The different tobaccos have individual processing lines, and each box in FIG. 5 represents a process step together with the corresponding apparatus. The different apparatus are connected to conveying elements such as channels or belts. One process step can often be illustrated by different apparatus, i.e. the processing step of drying can for example be performed in a drum dryer or an airflow dryer. The versatility of tobacco preparations which has occasionally been observed and has arisen through evolution, principally opposes the desire for standardization.

When consolidating working structures, tobacco preparation plants are generally difficult to relocate, since it is often not easily possible to transfer customized solutions to other sites.

A method for manufacturing comminuted tobacco material is known from DE 10 2004 059 388 B4, which illustrates how a comminuted, fibrous material which can directly be used in smoking products is manufactured from tobacco stem material with the aid of a screw extruder.

Furthermore, DE 10 2005 006 117.6 discloses a method which allows mixtures of tobacco stem materials to be extruded, with the addition of for example tobacco dust, in order to manufacture flavor-enhanced, fibrous materials comparable to cut tobacco and suitable for directly manufacturing smoking products.

BRIEF SUMMARY

The invention aims to optimize tobacco preparation. The intention is in particular to make the tobacco preparation as a whole more compact, with respect to its space and/or time requirement. Among other things, the intention is make the tobacco preparation—as a method sequence, but also as an apparatus array—easier to manipulate.

In the tobacco preparation method in accordance with the invention, a tobacco material is treated by at least one extrusion process which comprises compression using an increase in pressure and temperature, and mechanically processing and instantaneous-decompression drying the material at an extruder outlet. In accordance with the invention, the tobacco material—which here serves as the starting material—comprises a tobacco lamina material. In other words, the present invention can use an extrusion method so as to perform substantially the entire tobacco preparation sequence required for a lamina material, i.e. the highest-quality tobacco material. The invention has thus recognized that extrusion is suitable not only for treating tobacco by-products such as dust, winnowings, cutter knock-outs, stem fibers, scraps and short stems, but also as an attractive and compact solution for a lamina tobacco preparation, in particular for a complete replacement of a conventional tobacco preparation, i.e. the present invention implements the recognition that such extrusion is to be regarded as on a par with a classic tobacco preparation in lines, wherein a major advantage is that it is possible to save space and energy and therefore provide an environmentally friendly mode of operation exhibiting an increased process flexibility. In particular, the invention can realize an integrated mode of production, without tobacco by-products being incurred and with guaranteed high material yields. The line specialization practiced (Virginia, Burley, Orient, stems) can, however, in principle be maintained.

The compactness of the method in accordance with the invention and its implementation using apparatus then results specifically from processing a compressed product in the extruder, since it is then possible to process more product in a shorter time and within a smaller installation space. The bulk density of the tobacco mixture and the nominal annual capacity are to be regarded as the characterizing variables for the configuration of production plants and treatment apparatus. The throughput rate and therefore the annual capacity is a defined variable, whereas the bulk density—which is generally in the range of about 200 $kg/m^3$—can be influenced in accordance with the invention. Because the invention succeeds in running the tobacco processing processes in a "compressed tobacco phase" (at about 800 $kg/m^3$) using extrusion processing, the processing volume is reduced to one quarter. Since other process steps can also be performed, quasi-simultaneously, on the compressed tobacco volume in an extruder (for example, conditioning), time savings also arise.

Thus, in accordance with the invention, it is possible to more compactly and quickly process the tobacco lamina material or a tobacco material which comprises such tobacco lamina material, and the commercial significance of this recognition in accordance with the invention is considerable, since enormous plants for conditioning, threshing, drying, etc. can be made superfluous.

The tobacco material which is supplied to the method in accordance with the invention as the starting material can comprise a tobacco lamina material and a tobacco stem material, in particular a mixture of a tobacco lamina material and a tobacco stem material, specifically also substantially whole tobacco leaves. This shows one of the greatest advantages of the present invention, in particular in mixture processing, since aged (curing) raw tobacco can be supplied to the method either directly after harvesting, as whole leaves, or after having been threshed in a "Green Leaf Threshing (GLT) Plant" and separated as lamina (strips) and stems. In principle, Orient tobaccos enter the tobacco industry as whole leaves. The advantages of being able to supply mixtures of lamina (tobacco leaves) and stems are obvious and relate to combining separate process steps. Using whole leaf leads to a high savings potential, since threshing—i.e. separating the stems and leaves—becomes superfluous in practice.

The tobacco preparation method in accordance with the invention can be configured such that it comprises a single extrusion process which extrudes a tobacco material comprising a number of components and thus produces a tobacco preparation product. This variant is the most favorable in apparatus terms.

Conversely, the method in accordance with the invention can comprise a number of extrusion processes, at least one of which uses a tobacco lamina material as its starting material and/or material to be treated, wherein the extrusion products produced by the respective extrusion processes—together and/or in a mixture—form a tobacco preparation product. The advantage of such an arrangement is that the different tobacco materials can also be differently treated in their usual way.

One of the extrusion processes can treat tobacco stem material, while a number of extrusion processes of the tobacco preparation method can use a tobacco lamina material as their starting material and/or material to be treated, in particular two or three processes, wherein:

- in the case of two processes, in particular Burley tobacco lamina material on the one hand and a mixture of Virginia and Orient tobacco lamina material on the other are separately treated; and
- in the case of three processes, in particular Burley tobacco lamina material, Virginia tobacco lamina material and Orient tobacco lamina material are separately treated.

The extrusion processes illustrated can be performed in parallel with each other (spatially and chronologically), and it is possible for one, two, three or more extrusion processes for tobacco lamina material to be coupled to an extrusion process for tobacco stem material, wherein the tobacco preparation product results from the products of these extrusion processes.

A tobacco preparation assembly in accordance with the invention comprises at least the following components: a dosing conveyor; and an extruder which compresses a tobacco material using an increase in pressure and temperature, and mechanically processes and instantaneous-decompression dries the material at the extruder outlet. In accordance with the invention, the components as a whole are formed as a modularly distinguishable unit for processing a tobacco material which comprises a tobacco lamina material. In other words, the tobacco preparation assembly—on the one hand, in its smallest necessary form, or on the other hand also together with optional additional components—represents a module, i.e. a separate, self-contained unit, which allows it to be flexibly employed and manipulated, and spatially moved. This modular configuration results in tobacco preparation assemblies which are compact and can be universally employed and in particular shipped.

In an expanded embodiment, but still in a modular assembly (in corresponding individual units which can always be combined in the same way or in a similar way and so form a spatial unit), the tobacco preparation assembly also comprises at least one of the following components:

- a tobacco material reservoir, arranged upstream of the dosing conveyor; and
- a cooling device for the extruded tobacco preparation product, arranged downstream of the extruder.

The tobacco preparation assembly can of course also be configured such that it is suitable for performing a tobacco preparation method such as has been described above in different embodiments. The corresponding parts of the assembly and/or device which are necessary for performing the method steps are in particular provided for this purpose.

In the same sense, an array of a number of tobacco preparation assemblies in accordance with the invention is to be configured in a way suitable for performing one of the methods such as have been illustrated above with regard to "a number of extrusion processes", wherein it is possible to provide one assembly for each extrusion process and to collect the tobacco preparation products of the assemblies for further processing in the smoking product manufacturing process, in particular on a conveyor (belt conveyor, channel conveyor, etc.).

In accordance with the invention, a tobacco material reservoir comprising a different starting material or combination of starting materials in each case can be provided for each assembly, wherein the starting material or combination of starting materials in particular comprises one or a combination of the following materials:

Burley tobacco lamina material;
Virginia tobacco lamina material;
Orient tobacco lamina material;
tobacco stem material.

In accordance with advantageous embodiments in accordance with the invention, said assembly or the assemblies of an assembly array are characterized by at least one of the following features:

- at least one of the tobacco material reservoirs is a silo, specifically a raised silo, from which the tobacco material is dispensed downwards by the effect of gravity;
- the dosing conveyor is a screw conveyor;
- the extruder is a screw extruder comprising an adjustable shearing gap outlet;
- the cooling device is a conveyor belt cooler;
- the tobacco preparation product is transported away from the respective assembly by a conveyor belt and, as applicable, the products of a number of assemblies are collected on a conveyor belt.

In its most comprehensive form, the present invention relates to a smoking product and/or cigarette manufacturing device comprising an assembly or assembly array such as have been described above in different embodiments, wherein the assembly or assembly array is arranged as a tobacco preparation module (primary module) upstream of a cigarette maker (secondary unit or cigarette manufacturing machine), in particular immediately upstream at an interface. This clearly shows how the modular tobacco preparation in accordance with the present invention can be universally and optimally employed and/or manipulated, with all its advantages. Due to its small space requirement and high throughput and in particular also due to its broad range of possible settings with respect to the quality and quantity of the end product (conditioning in the extruder), the modular tobacco preparation can be shipped anywhere and employed instead of the previously necessary large-area tobacco preparation plants. In particular, it can even for example be shipped to tobacco manufacturing countries in which—for the reasons given above—it is also possible to omit the threshing device, such that a significantly quicker, more efficient and space-saving production is enabled.

Thus, in its basic design and in its different embodiments, the tobacco preparation in accordance with the invention implements the following features:

Process steps of conventional tobacco preparations are combined or completely eliminated, and a "compressed mode of operation" additionally saves on the enclosed building volume (floor area of the building). During throughput, the moisture profile can be varied once to a maximum of 25% between the delivery moistness and the processing moistness, which of course considerably reduces the energy consumption and the incidence of exhaust vapors and exhaust gases. In addition, existing restrictions with respect to the choice of starting materials no longer apply; it is even possible to use whole leaves. Process steps which can be omitted or replaced substantially include at least some of the following:

- the threshing process in the Green Leaf Threshing Plant, since whole leaf processing is in principle possible;
- typical conditioning and cutter lines;
- Burley Process toasting (duplex drying);
- drying tobacco by contact on warm (hot) surfaces in drums and/or by convection in airflow dryers, fluid bed dryers or by capacitive drying in screw conveyor elements such as extruders; and
- apparatus for flavoring.

In terms of capacity, the infrastructure of the cigarette factory is substantially unburdened by plants which are subject to emissions legislation, such as for example dust extraction plants, exhaust vapor treating plants and sewerage treating plants.

BRIEF DESCRIPTION OF THE DRAWINGS

The invention is illustrated below in more detail on the basis of different embodiments and with reference to the enclosed figures. It can comprise the features described here, individually and in any combination, and can be understood as a method, a device or a use comprising the corresponding assignable features. The enclosed drawings show:

FIG. 2 variants of an assembly array in accordance with the invention, in the form of a table;

DETAILED DESCRIPTION

Figure 1:
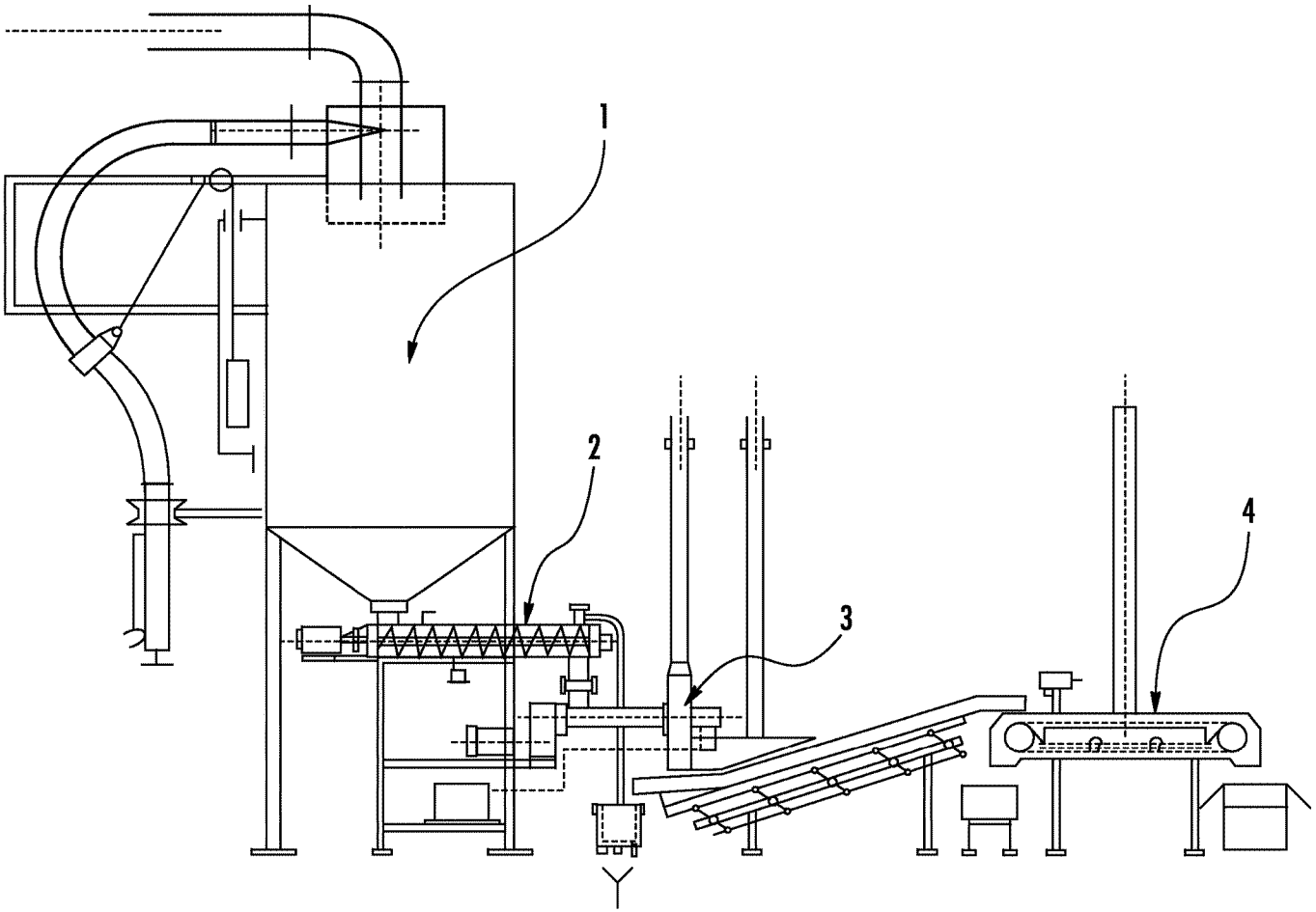
FIG. 1 a schematic representation of an extrusion tobacco preparation module in accordance with the invention.

In the embodiment shown in FIG. 1, a processing unit—i.e. an extrusion module—comprises the following components: a mixing silo 1, in which tobacco material is assembled as a batch, wherein a formula is devised; a dosing screw 2, which doses the tobacco material by volume and/or mass and transports it away from the silo 1; an extruder 3, to which the dosed tobacco material is delivered and in which the following steps are performed:

- conditioning with water/steam and, as applicable, casing;
- compressing, mixing, heating, dwelling, flavoring, aromatizing;
- shaping tobacco fibers which have been cut lengthways, to form a tobacco heap, while decompression-drying and simultaneously restoring the natural filling capacity by expanding to ambient pressure.

Lastly, the module as a whole also comprises the cooling unit 4 which serves to fix the structure and extract adhering steam. The mixing silo 1 can be fed with whole packages, either with the aid of a slicer or a breaker, before they enter the mixing container. Furthermore, the bulk material which is pre-broken in this way can then be homogenized using a silo mixer and further processed.

It should be noted with respect to the extruder that it can comprise a heatable pressure chamber which can comprise a tobacco material inlet on the low-pressure side and a tobacco material outlet on the pressure side, and a conveying device (a filling screw for conveying the tobacco material from the inlet to the outlet). The tobacco material outlet exhibits a flow channel cross-section (defined by the gap and profiling) for the passage of the tobacco material while being decompressed, and the flow channel cross-section preferably has gap walls which can be moved relative to each other and can exhibit roughening or profiling. The gap walls can also be able to be moved away from each other and towards each other, biased towards the closed state of the gap and can be moved relative to each other at a fixed or fixedly settable distance (0.01 mm to 2 mm). The roughening can be grooves or cross-profiling, and the gap can be an annular gap, cylindrical gap or a conical gap, the gap walls of which can in particular be continuously or intermittently moved back and forth relative to each other. The extruder screw can exhibit measures which reduce the chamber volume towards the region of the outlet, in particular decreasing screw pitches or increasing extruder shafts, and it is possible to arrange mechanical pre-comminuting means and/or pre-defibrating means in the pressure chamber. Inlets for conditioning or casing means and/or steam can be provided at the pressure chamber.

The enclosed FIG. 2 shows variants in accordance with the invention in the form of a table, together with the number of extruders (extruder cells and/or extruder modules) necessary. If whole leaves are used without tobacco specialization, then a minimum of just one extruder is necessary. The mixture formula is then realized in a silo of the extruder module, as shown in FIG. 1, and no distinction is made in process terms between for example Virginia, Burley, Orient and stems. When using whole leaves, the proportion of the structuring agent cellulose corresponds to the natural content in the leaves and is therefore regarded as particularly advantageous with respect to the product characteristics.

Embodiments are conceivable in which a separate extruder treatment of different tobacco materials and/or lamina varieties is performed, and the second line in FIG. 2 shows a variant in which threshed tobacco is used, i.e. in which stems and lamina are separately treated. This necessitates a minimum of two extruders, and it is possible to set different cutting widths for the stems and lamina and/or to select different casing variations.

If, in accordance with the third and fourth variants in FIG. 2, the classic specialization of the lines is to be maintained, then three to four extruders are required, namely for Burley, Virginia, Orient and stems. The advantage of this approach is that it is possible to provide specialization using different process parameters and casing applications and other parameters (Burley extruder toasting, etc.). If the stems and Burley are separately treated, but the Virginia and Orient are treated together, then a minimum of three extruders are necessary; if the stems, Burley, Virginia and Orient are separately treated, then at least four extruders are needed and the invention becomes an illustration of standard tobacco treating, but with extruder modules and the corresponding space-saving and all the other advantages in accordance with the invention which have already been described.

Combinations are of course possible, such as for example separately processing according to stems and leaves, wherein Burley, Virginia and Orient are processed together in one extrusion module.

Figure 3:
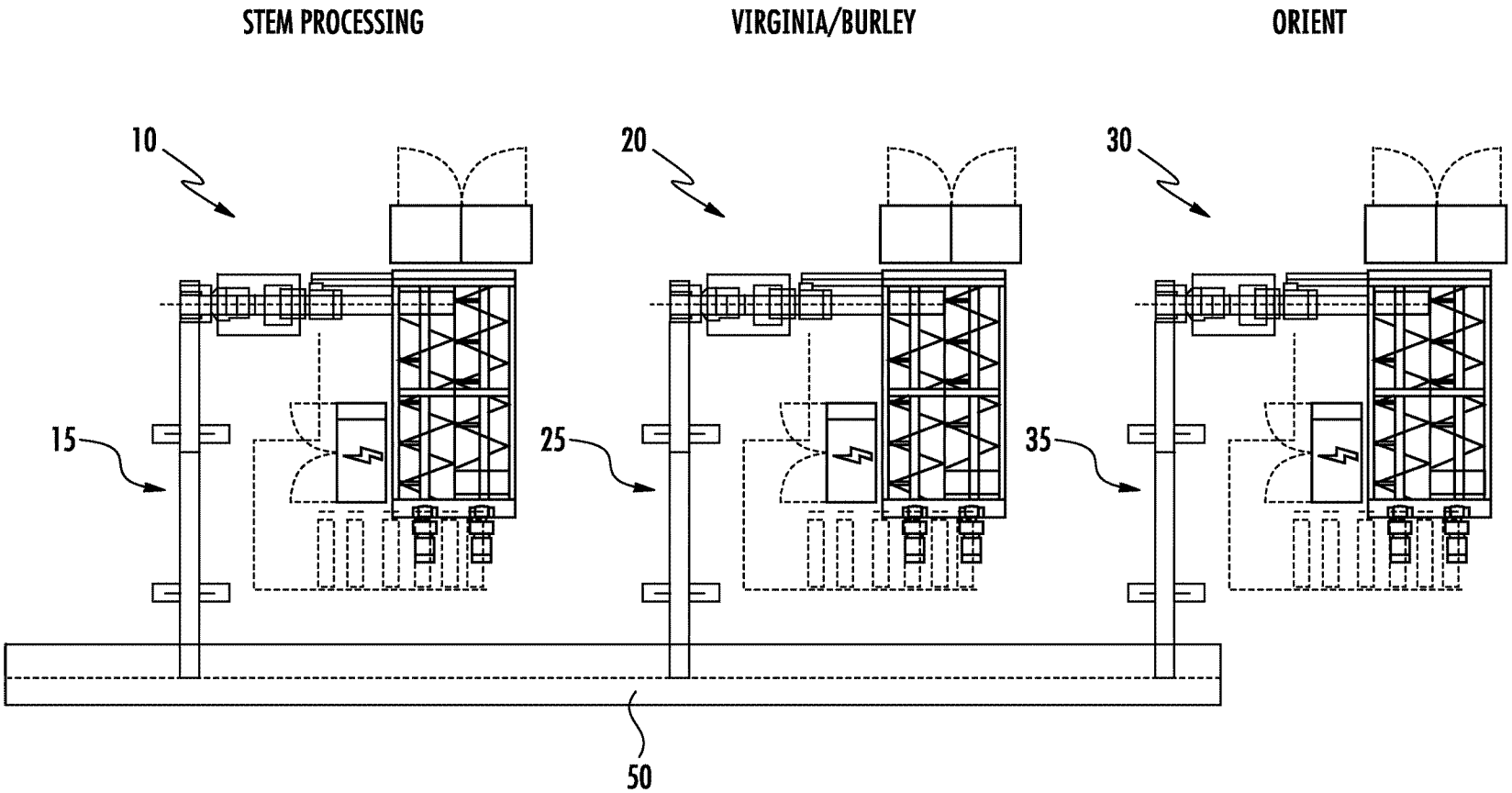
FIG. 3 a number of tobacco preparation assemblies in accordance with the invention, for different tobacco materials, interconnected to form a production module.

One of the aforesaid versions is shown in FIG. 3, wherein a stem processing module 10, a Virginia/Burley processing module 20 and an Orient module 30 respectively perform an extrusion tobacco preparation in accordance with the invention and then respectively deliver the extruded product via the conveyors 15, 25 and 35 to a common conveyor 50 which then forms the interface to the subsequent cigarette manufacture and/or to the cigarette maker.

Figure 4:
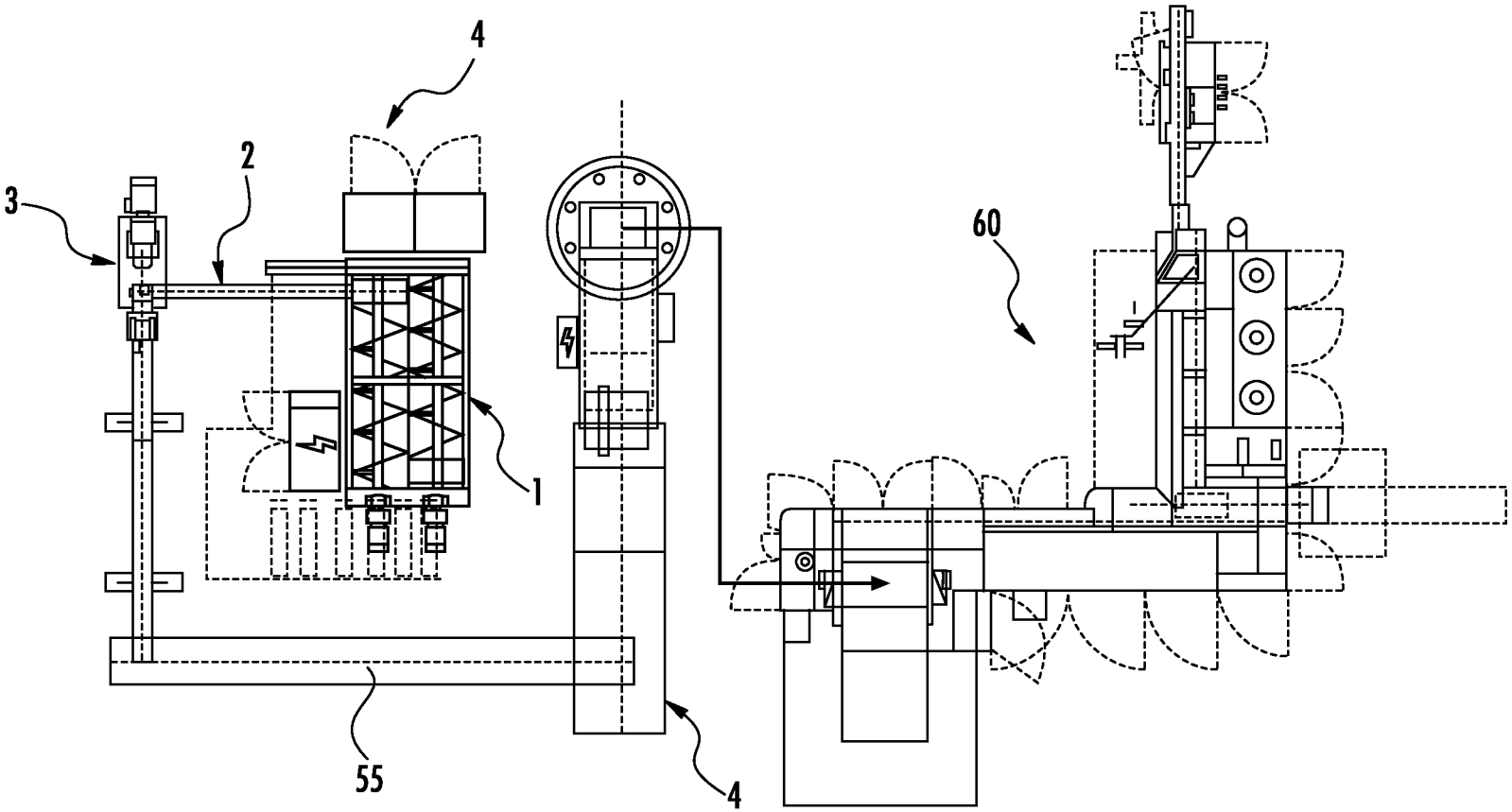
FIG. 4 interconnecting a tobacco preparation module in accordance with the invention and a cigarette maker to form a cigarette manufacturing plant and/or cigarette factory, in a schematic representation.
Figure 5:
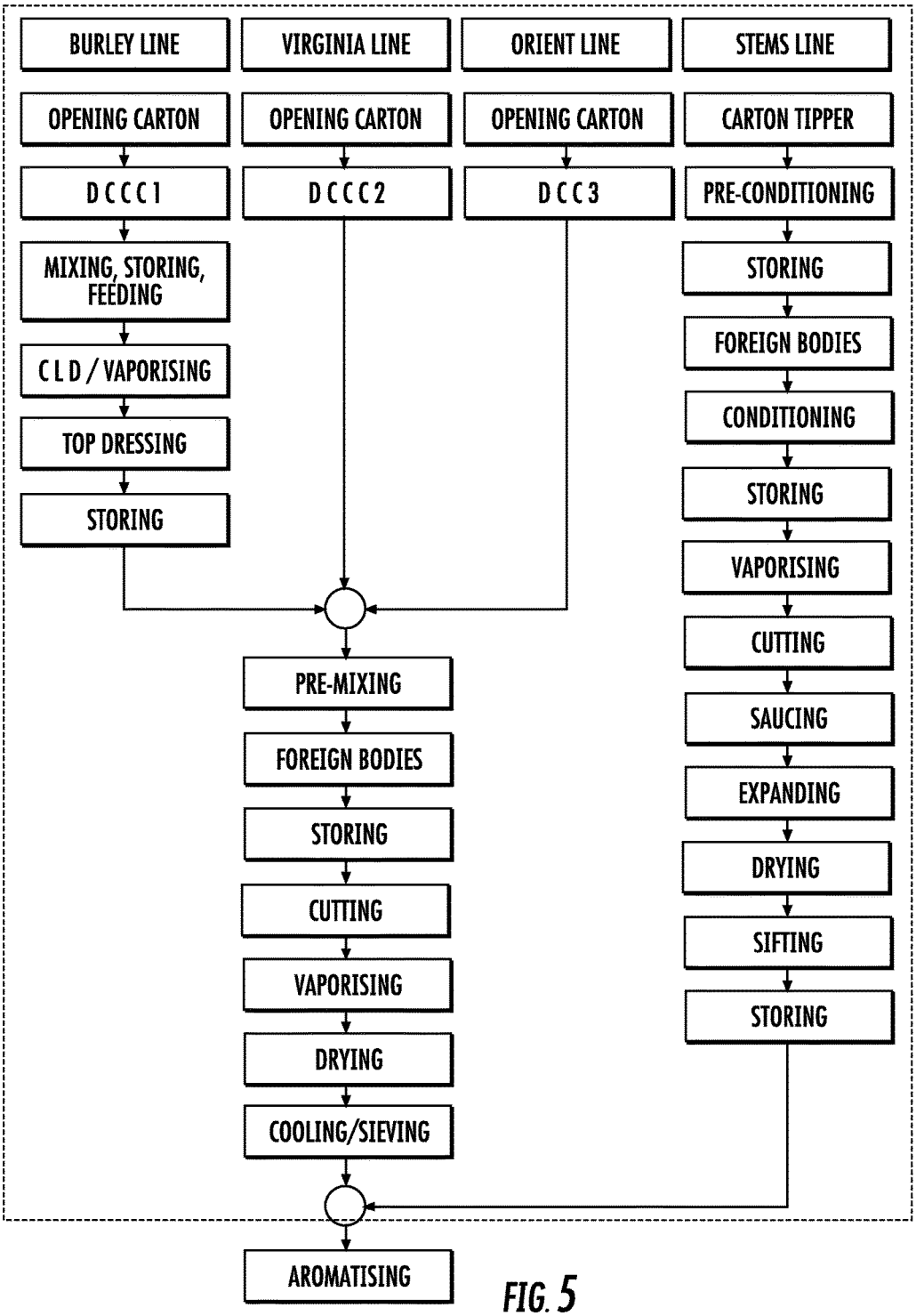
FIG. 5 PRIOR ART
FIG. 5 the conventional tobacco preparation for different tobacco materials as a flow diagram, to which reference has been made at the beginning in the discussion of the prior art.

FIG. 4 as a whole shows a cigarette manufacturing device or "small cigarette factory" comprising an extrusion module 40 (silo 1, dosing screw 2, extruder 3, conveyor 55, dryer 4) which is arranged immediately upstream of a cigarette maker 60, wherein the tobacco preparation module 40 thus forms part of a cigarette machine (or a small group of cigarette machines), virtually in a ratio of 1:1. Introducing such a design in accordance with the invention and/or introducing the modular tobacco preparation in accordance with the invention enables independent production modules for tobacco preparation and cigarette manufacture to be provided, and a future factory could comprise integer multiples of such mini-factories as shown in FIG. 4. This design makes cigarette manufacture and/or smoking product manufacture significantly more flexible.

The capacity can be adapted with regard to tobacco throughput to the requirements of the cigarette machine (requirements of the maker) either by the dosing conveyor of the extruder itself (a small setting range through variations in rotational speed) or by the number of extruders per silo (a large setting range through duplicating the base unit). Aromatizing can also be incorporated here, for example as the proven online aromatizing during cigarette manufacture. It can, however, also be performed beforehand in a flavor drum, together with mixing the material, before it is passed on to the tobacco silo.

An extrusion cell, illustrated for example in FIGS. 3 and 4 by 20, 30 and 40 respectively, can require an installation space of 15×15 m for an output capacity of up to 1000 kg/h. In summary, it may be said that the invention provides a resource-saving tobacco treatment (energy, incidence of exhaust vapors, etc.) without pre-treating the tobacco material, with an almost 100% raw material yield, in a compact extrusion module.

In one method example of tobacco treatment in accordance with the invention, different Virginia grades are provided in the form of strips and mixed in a silo 1 comprising cutting mixer units for fibrous plant materials, without being moistened, in accordance with a formula, wherein the batch size is defined at 4000 kg. During mixing, additional comminuting of the breakable leaf material is deliberately tolerated. The dust which thus arises serves to stabilize the course of the process. It can perfectly well be advantageous to also make tobacco dust or other small tobacco materials from other sources part of the formula.

The batch prepared in this way is supplied with the aid of a dosing screw 2 to the extruder 3, where it is formed into a fibrous tobacco product, as has already been described.

The yield is then almost 100%. Instantaneous expansion creates attractive filling capacities of for example 5.1 ml/g, and the product is visually indistinguishable from the classic product. The dust and/or other small tobacco parts are bonded to the resultant fibrous tobacco material during the compression and extrusion process, which results in the high material yield. The cigarettes produced are of a high quality and are easily within the quality range of classic tobacco treatment. In addition, they are visually indistinguishable from cigarettes in which a classic tobacco treatment has been used. The hardness of the cigarettes is even improved, i.e. reduced, in the tobacco preparation in accordance with the invention.

Thus, the present invention enables a flawless smoking product to be produced, with all the cited advantages with regard to the ability to manipulate the tobacco preparation, its productivity, and the savings in installation space, energy costs and plant costs.

The invention claimed is:

1. A tobacco preparation assembly array comprising:

a plurality of tobacco preparation assemblies, wherein each assembly includes:

a dosing conveyor; and an extruder that compresses a tobacco material using an increase in pressure and temperature, and mechanically processes and instantaneous-decompression dries the material at a shearing gap outlet of the extruder;

wherein a cutting width of the extruder of a first assembly differs from a cutting width of the extruder of a second assembly, wherein an assembly is provided for each extrusion process, wherein the extrusion processes are performed in parallel, wherein, at least one extrusion process uses a tobacco lamina material as a starting material;

a mixture of extrusion products produced by the respective extrusion processes forms a tobacco preparation product; and the tobacco preparation product is collected for further processing in a smoking product manufacturing process on a conveyor.

2. The array according to claim 1, wherein a tobacco material reservoir comprising a different starting material or combination of starting materials is provided for each assembly, the starting material or combination of starting materials including at least one of the following materials:

Burley tobacco lamina material;

Virginia tobacco lamina material;

Orient tobacco lamina material; and tobacco stem material.

3. The array according to claim 2, wherein the tobacco material reservoir of at least one the assemblies is a raised silo from which the tobacco material is dispensed downwards by the effect of gravity.

4. The array according to claim 1, wherein the array is arranged as a primary module upstream of a secondary unit in a smoking product manufacturing device.

5. The array according to claim 1, wherein the dosing conveyor is a screw conveyor and the extruder is a screw extruder comprising an adjustable shearing gap outlet.

6. The array according to claim 1, further comprising a cooling device for the tobacco preparation product arranged downstream of the extruder, wherein the cooling device is a conveyor belt cooler, the tobacco preparation product being transported away from the respective assembly by the conveyor belt.

* * * * *